United States Patent [19]

Ryan

[11] Patent Number: 5,040,318

[45] Date of Patent: Aug. 20, 1991

[54] FABRICATION OF PANELS, BINDERS, TRAYS, FRAMES, BOXES AND OTHER ASSEMBLIES FROM SHEET MATERIAL AND CHANNEL-SHAPED EDGING STRIPS

[76] Inventor: Keith Ryan, 121 Parkside Way, Harrow, Middlesex HA2 6DB, United Kingdom

[21] Appl. No.: 87,963

[22] Filed: Aug. 17, 1987

Related U.S. Application Data

[63] Continuation of Ser. No. 249,923, Apr. 1, 1981, abandoned.

[30] Foreign Application Priority Data

Apr. 8, 1980 [GB] United Kingdom ..... 8011480

[51] Int. Cl.[5] ..... G09F 11/06

[52] U.S. Cl. ..... 40/396; 40/152; 52/71; 52/475

[58] Field of Search ..... 52/71, 70; 40/530, 152, 40/396

[56] References Cited

U.S. PATENT DOCUMENTS

| | | | |
|---|---|---|---|
| 1,500,035 | 7/1924 | Rand . | |
| 1,598,257 | 8/1926 | Rand | 40/396 |
| 1,641,293 | 9/1927 | Ringler | 40/396 |
| 1,904,349 | 4/1933 | Barlow | 40/396 |
| 2,225,503 | 12/1940 | Link | 40/396 |
| 2,749,636 | 6/1956 | Viglietta | 40/152 |
| 2,755,484 | 7/1956 | Hotz | 160/392 |
| 2,777,232 | 1/1957 | Kulicke et al. . | |
| 2,886,481 | 5/1959 | Swan | 160/391 |
| 3,060,606 | 10/1962 | Peach . | |
| 3,177,501 | 4/1965 | Kwake | 160/392 |
| 3,200,526 | 8/1965 | Munn . | |
| 3,460,860 | 8/1969 | Stevens | 52/71 |
| 3,793,758 | 2/1974 | Feldhusen | 46/31 |
| 4,158,244 | 6/1979 | Stefan | 160/391 |

FOREIGN PATENT DOCUMENTS

| | | |
|---|---|---|
| 15944/34 | 1/1934 | Australia . |
| 2505025 | 8/1976 | Fed. Rep. of Germany . |
| 2614206 | 10/1977 | Fed. Rep. of Germany . |
| 2058497 | 5/1971 | France . |
| 2351799 | 12/1977 | France . |
| 2358277 | 2/1978 | France . |
| 43-22089 | 9/1968 | Japan . |
| 52-40818 | 9/1977 | Japan . |
| 53-50508 | 12/1978 | Japan . |
| 652040 | 4/1951 | United Kingdom . |
| 812469 | 4/1959 | United Kingdom . |

*Primary Examiner*—John E. Murtagh
*Attorney, Agent, or Firm*—Wong & Husar

[57] ABSTRACT

The invention relates to the fabrication of panels, trays and other assemblies from fibreboard or other sheet material by folding-back edge portions of the sheet to provide marginal portions of increased thickness and substantially uniform width of which the inner edges define retaining abutments, each marginal portion being located in a channel of respective channel-shaped edging strips each having a lip or rib which engages over and with the retaining abutment of the marginal portion to resist separation of the strip from the edge of the sheet in the direction perpendicular to said edge. The edging strips are assembled to an edge by forcing the channel over the marginal portion. Adjacent edging strips engage to resist sliding movement.

22 Claims, 3 Drawing Sheets

Fig.7
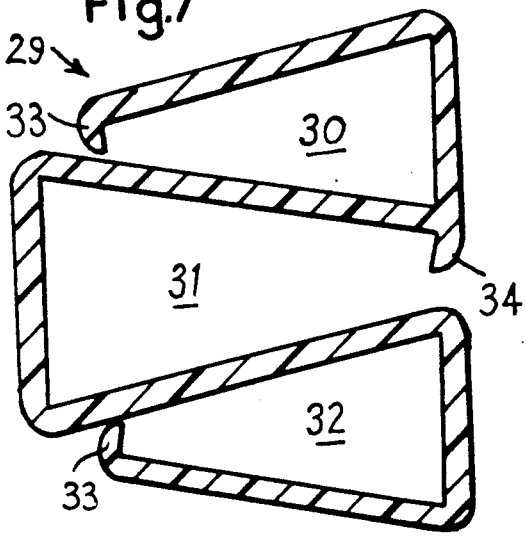
Fig.9
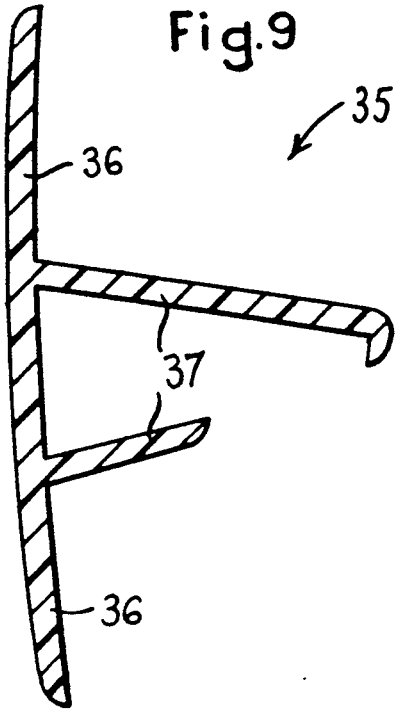
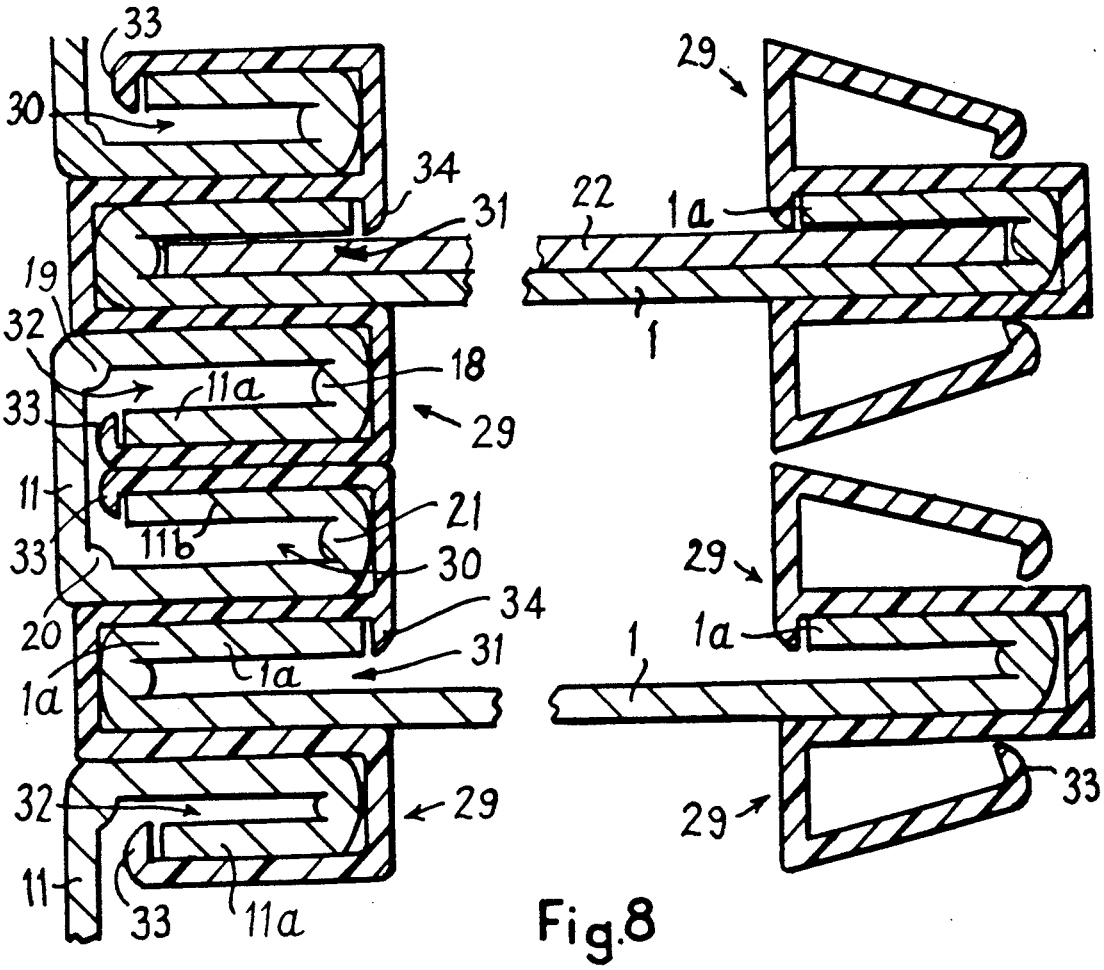
Fig.8

FABRICATION OF PANELS, BINDERS, TRAYS, FRAMES, BOXES AND OTHER ASSEMBLIES FROM SHEET MATERIAL AND CHANNEL-SHAPED EDGING STRIPS

This is a continuation of application Ser. No. 249,923, filed Apr. 1, 1981, and (now abandoned).

BACKGROUND OF THE INVENTION

This invention relates to the fabrication of panels, binders, trays, frames, boxes and other assemblies from sheet material and channel-shaped edging strips, on or in which can be stored, displayed, secured or filed one or more documents, papers, cards, strips, microfilms, microfiches, pictures, photographs or other records or articles. The invention is particularly, but not exclusively, applicable to fabricating panels or binders for holding the records of a visible index as shown, for example, in my U.S. Pat. No. 4,231,176.

It is known to secure channel-shaped edging strips to the edges of sheets of fibreboard, cardboard, plywood and other materials to produce articles of various kinds. It is also known to clip the edges of documents together by resilient channel-shaped edging strips; see, for example, French Patent Publication No. 2059495; and to attach the folded-back edges of filing folders and visible index record cards in channel-shaped support carriers having an inwardly extending flange or member by which the folded-back edge is supported; see, for example, French Patent Publications Nos. 2351799 and 2358277, DTOS 2614206, British Patent 652040 and U.S. Pat. Nos. 1,500,038 and 1,528,257. It is also proposed in French Patent Publication No. 2142337 and DTOS 2505025 to detachably secure an enlarged or folded-back edge of pattern sheets in hingedly interconnected channel-shaped members to construct pattern books.

SUMMARY OF THE INVENTION

The invention has for its object to provide a method and components which enable such assemblies to be easily and inexpensively constructed in a multiplicity of different designs, sizes, colours and finishes, and which enable panels to be assembled in multiple units, from basic components comprising sheet material, such as fibreboard and cardboard of appropriate thickness, and edging strips of single or multiple channel configuration made of plastics material, metal, wood or other suitable material, and without necessarily having to use adhesives or complex production or assembly methods.

Basically, according to the invention, an assembly fabricated from fibreboard or other sheet material, such as cardboard, plastics or metal, of the required size and appropriate thickness, and edging strips is characterized by each of at least two of the edges of the sheet having, at least part way along its length, a marginal portion of increased thickness and of substantially uniform width, the inner edges of said marginal portions defining retaining abutments and each marginal portion being located in a channel of respective channel-shaped edging strips, each strip having therealong a lip or rib projecting inwardly of the inner surface of at least one of its channel walls and engaging over and with the retaining abutment of the associated marginal portion to resist separation of the strip from the edge of the sheet in the direction perpendicular to said edge, the edging strips being dimensioned to be assembled to an edge of the sheet by forcing the said channel thereof over the marginal portion of increased thickness in the direction perpendicular to said edge until the lip or rib of the channel engages over and with the associated retaining abutment.

The marginal portions of increased thickness are conveniently formed by folding back edge portions of the sheets.

In the case of a rectangular panel, all four edges of the sheet may be folded back and located in respective channel-shaped edging strips.

The edging strips may be made of plastics, metal, wood or other suitable material. They are preferably made of resilient or springy material so that the insertion of the folded-back edge of the panel into the channel causes the channel walls to be resiliently flexed apart, the resilience of the channel walls maintaining the edge of the panel in its folded condition with the lip or rib firmly engaged over the free edge of the folded-back edge portion. The strips may be conveniently extruded of a plastics material, such as P.V.C. of a suitable grade and of a desired colour.

Many sheet materials of a thickness appropriate for this invention tend to open up the folded-back portion, even if the fold be defined by a heavy crease line. The assembly according to this invention not only retains the folded back portion in place, without the necessity of securing the folded-back portion with adhesive, stitching or staples, by means of the edging strip, but also takes advantage of the inherent spring-back of a folded-back portion to assist in maintaining the engagement of the free edge of the folded-back portion with the lip or rib of the edging strip. Advantage can also be taken of this spring-back tendency of the folded-back portion in the case where the channel walls are spaced a substantially fixed distance apart, for example when the channel is formed by an appropriately shaped groove in a wooden edging strip.

In this specification, by a sheet material of "appropriate thickness" is meant that the sheet material must possess sufficient thickness to provide adequate rigidity to the finished, edged panel and also to provide a folded-back portion with a free edge of adequate thickness to provide a firm abutment against which the lip or rib of the edging strip can engage.

Binders or folders comprising two or more panels may be assembled by the use of a spine member comprising a strip of sheet material, such as that used for the panels, having folded-back edge portions along two opposite edges which are inserted in the channels of the edging strips of adjacent panels and are formed to provide hinge zones between the folded-back portions, for example by providing the strips with hinge creases. Preferably for such multiple assembles the edging strips comprise two or more channels with appropriately positioned lips or ribs to engage the edges of the folded-back portions of the panels and spine or spines.

BRIEF DESCRIPTION OF THE DRAWINGS

In order that the invention may be more clearly understood, reference will now be made to the accompanying drawings, in which:

FIG. 7 is a section of three-channel edging strip, as extruded, FIG. 8 is a section of a multiple assembly using the edging strip of FIG. 7, FIG. 9 is a section of top and bottom edging strips for use with the three-channel strip of FIG. 7.

DESCRIPTION OF THE PREFERRED EMBODIMENTS

In the embodiments to be described it will be assumed that the sheet material is fibreboard, which may be embossed and coloured, of about 1 mm to about 1.5 mm thickness, and that the edging strips are extruded of a resilient plastics material.

Figure 1:
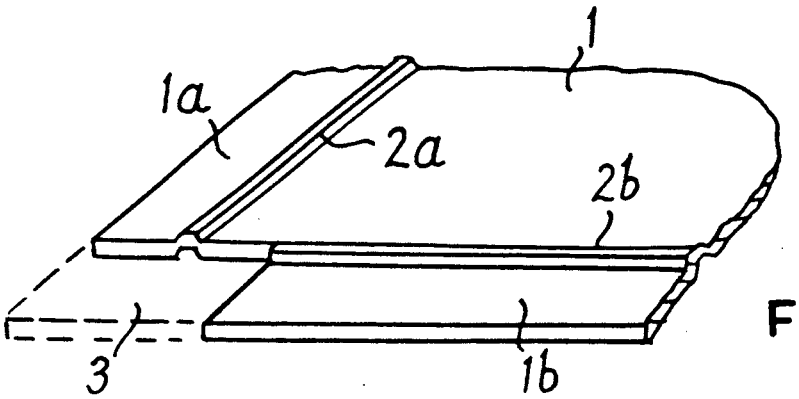
FIG. 1 is a perspective view of a corner fragment of a cut and creased piece of fibreboard for forming a panel.
Figure 2:
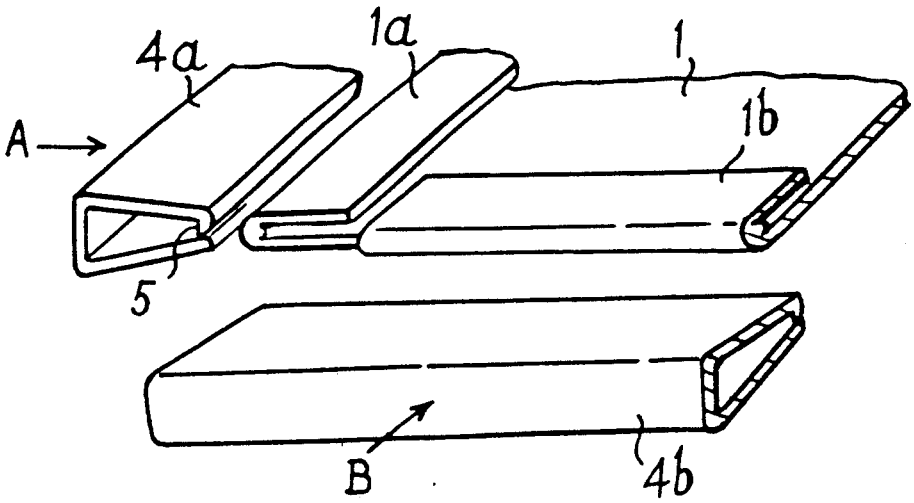
FIG. 2 is a view similar to FIG. 1 but showing the edge portions folded-back to provide marginal portions of increased thickness and with edging strips in exploded positions.

A corner fragment of the panel sheet 1, before folding, is shown in FIG. 1. It is provided with fold creases 2*a*, 2*b* parallel to the respective sheet edges. The corner region 3 has been cut away to allow the respective edge portions 1*a*, 1*b* to be folded back upon themselves as shown in FIG. 2 to provide the sheet 1 with marginal portions of increased thickness and substantially uniform width. As shown, the corner region 3 is cut away to such an extent that the edge portions, when folded-over, will not overlap at the corners, but this is not essential.

Figure 3:
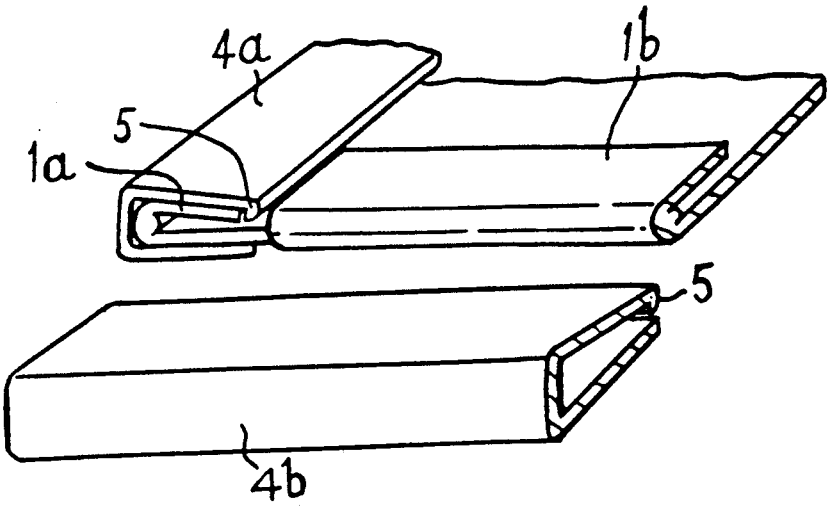
FIG. 3 is a view similar to FIG. 2 with one of the edge strips clipped on to a folded back edge of the panel.

FIG. 2 shows the corner fragment of FIG. 1 with the edge portions 1*a*, 1*b* folded back over the sheet. Also shown in FIG. 2, in exploded positions, are fragments of two edging strips 4*a*, 4*b*, each of channel-shaped cross-section with a lip 5 extending inwardly of the channel along the free edge of one of its channel walls. The strips are extruded so that the channel walls are inclined towards each other. They are resiliently flexed apart when each strip is clipped over its associated folded-back portion (as shown in the case of strip 4*a* in FIG. 3) by movement in the directions of the respective arrows A, B (see FIG. 2). The distance between the lip 5 and the base of a channel corresponds to the width of the folded-back marginal portions 1*a*, 1*b* so that it engages over the retaining abutment defined by the free inner edge of the folded-back portion, when fully forced thereover, to resist separation of the strip from the panel in the direction perpendicular to its edge. The strip 4*a* may be first clipped to the panel edge, then the strip 4*b* and so on for the other two sides of the panel. By assembling the strips so that one of the channel walls locates within the channel of the adjacent strips at the corners of the panels, the strips are locked against lengthwise sliding of the strips without the necessity of providing special corner pieces to resist such sliding movement. Thus strip 4*b* is assembled by locating its upper channel wall overlying the strip 4*a* and its lower channel wall between the underside of the panel 1 and the lower channel wall of the strip 4*a*.

Figure 5:
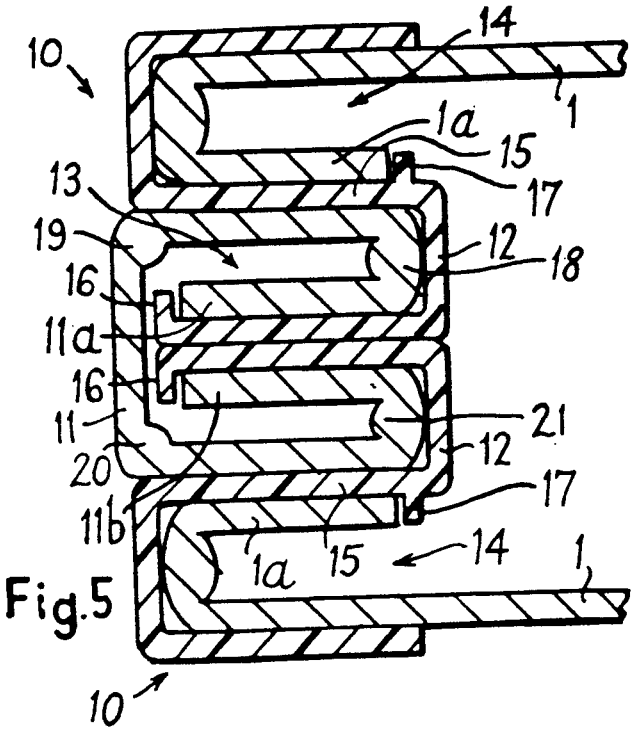
FIG. 5 is a section through a multiple panel assembly using the strip of FIG. 4.
Figure 4:
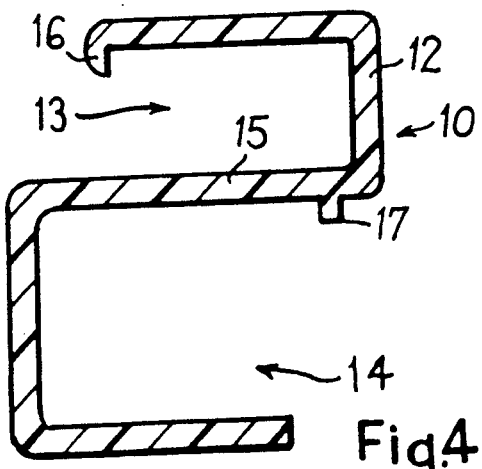
FIG. 4 is a section of an edging strip with two channels, as extruded.
Figure 6:
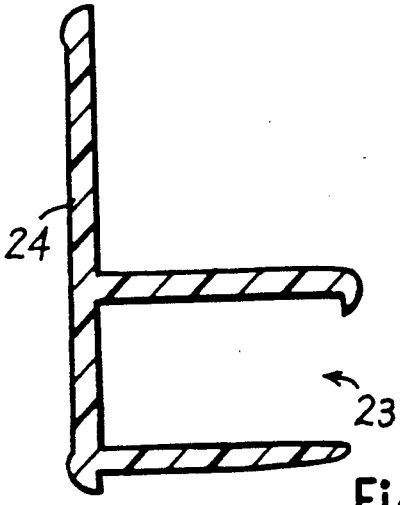
FIG. 6 is a section of another edging strip.
Figure 10:
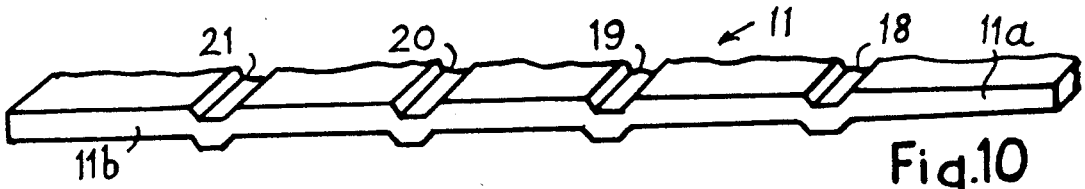
FIG. 10 is a perspective view of a fragment of a spine member showing the fold creases.
Figure 11:
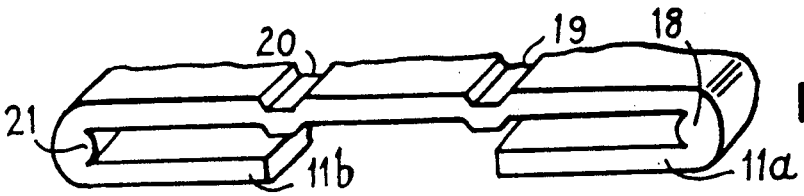
FIG. 11 shows the edge portions of the spine member folded back.

FIGS. 4 to 6 show an embodiment comprising an assembly of two panels connected in book-like fashion along one side by a spine member. A double-channel edging strip 10 is used to connect a panel to the spine member 11. The strip 10 is extruded with a cross-section as shown in FIG. 4 and comprises two channels 13, 14 which open in opposite directions and have a common channel wall 15. The channel 13, which serves for receiving a folded-back edge portion of the spine member, has an inwardly projecting lip 16 along its free edge, and the channel 14 has a lip 17 projecting from the common wall 15. The folded-back portion 1*a* of the panel 1 is inserted into the channel 14 and retained by the lip 17 as shown in FIG. 5. The spine 11 comprises a strip of fibreboard having four fold creases 18, 19, 20, 21 along its length as shown in FIG. 10. The edge portions 11*a*, 11*b* are folded back about the creases 18, 21 as shown in FIG. 11. The remaining creases 19, 20 form hinges for the spine as will be apparent from FIG. 5 which shows the folded-back portions 11*a*, 11*b* located and retained in the channels 13 of the edging strips associated with the respective panels. Double-channel edging strips 10 are preferably secured along the opposite side edges of the panels so that the panels will be located substantially parallel when the folder is closed. In this embodiment, the channels 14 are wider than the channels 13 to provide sufficiently wide channels beneath the folded-back portions 1*a* slidably to receive the ends of record carriers of a visible index, as described in U.S. Pat. No. 4,231,176.

Top and bottom edging strips 23 are conveniently formed with a cross-section as shown in FIG. 6, including a wall portion 24 which serves as an end stop for the spine and resists axial sliding thereof and the associated edging strips.

FIGS. 7 to 9 show another form of edging strip comprising three channels which enables more than two panels to be hingedly assembled together. The cross-section of the edging strip 29, as extruded, is shown in FIG. 7 and comprises three channels 30, 31, 32. Channels 30 and 32 have lips 33 along their free edges and channel 31 has a lip 34 projecting from its side wall which is common with the channel 30. As shown in FIG. 8, channel 31 is clipped over the folded-back edge 1*a* of the panel 1 and the channels 30 and 32 are clipped over the folded-back edges 11*a* of successive spine members 11, which again may be constructed as illustrated in FIGS. 10 and 11. The opposite side of each panel may be similarly equipped with a three-channel edging strip 29, as shown, to maintain the panels substantially parallel when the assembly is closed. In this embodiment, the top and bottom edging strips 35 conveniently have the configuration shown in FIG. 9, and include wall portions 36 which, after assembly to the panel, extend over the ends of both channels 30 and 32. Both channel walls 37 of edging strip 35 are conveniently located between the walls of channel 31 of the strips 29 when assembled. If desired, the top panel of an assembly, which forms a cover, may be connected to the assembly by a double-channel of the kind shown in FIG. 4.

It will be appreciated that the lips or ribs of the edging strips cover the free edges of the folded-back portions and protect them from becoming tatty. The channels also protect the outer surfaces of the folds of the folded back edges where the fibres of the fibreboard become stretched and are more easily worn.

If the spine member of an assembly should become worn or damaged, it is an easy matter to replace it with a new spine member.

Figure 12:
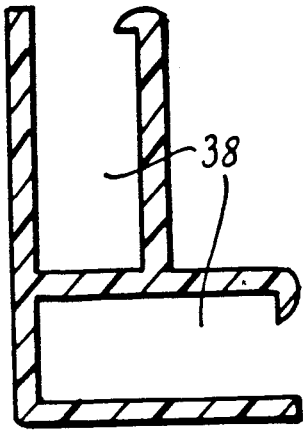
FIG. 12 is a section of a modified edging strip.

Whilst particular embodiments have been described, it will be understood that various modifications may be made without departing from the scope of the invention. Other ways of assembling the spine members are possible. The edging strips may be provided with additional channels oriented generally perpendicularly to the channel receiving the panel edges. These additional channels may be used for receiving the folded-back edge portions of spine members or for receiving folded-back edge portions of other sheet members, for example for forming box-like structures with the perpendicular channels 38 of FIG. 12.

Separate cut-outs or sub-assemblies of fibreboard or other material required for the purpose of completing the panel to enable it to serve its intended purpose, may be secured by their edges being located beneath folded-back marginal portions of a panel. In the construction of photo-frames, a sheet of glass or transparent material 22 (FIG. 8) may be secured by locating its edges beneath the folded-back marginal portions. The edging strips may be mitred at their corners. Further it is not necessary that edging strips should be provided around all the edges of a panel and a lip or rib may be located along the inner surface of a channel wall and remote from its free edge.

For some purposes the folded-back marginal portions of a panel may be replaced by separate strips secured to the panel by adhesive, stitching or other means. The edging strips of this invention can interengage with such separate strips to achieve the panel constructions and multiple assemblies of this invention. The use of separate strips, however, is not the preferred way of carrying out this invention.

I claim:

1. In the art of fabricating panels, binders, trays, frames, boxes and other articles, the combination of two assemblies each comprising a generally rectangular sheet of relatively rigid material having four straight edges, said four edges having marginal portions therealong of greater thickness than the remainder of the sheet, each said marginal portion being of substantially uniform width and having an inner edge defining a retaining abutment and being located in a channel of a channel-shaped edging strip having therealong a rib projecting inwardly of the inner surface of one of the channel walls thereof and engaging over and with the retaining abutment to resist separation of the edging strip from said edge of the sheet in a direction perpendicular to said edge, said edging strip being dimensioned to be assembled to said edge by forcing the channel of the edging strip over the marginal portion of greater thickness in a direction generally perpendicular to said edge until the rib of said channel engages over and with the retaining abutment of said marginal portion, said edging strip comprising abutment means for engaging, at adjacent corners of the assembly, with the edging strip along each adjacent edge in a manner to resist sliding removal of the edging strip from the sheet in a direction parallel to the edge to which it is assembled, and a spine member comprising a strip of sheet material having folded back edge portions along opposite edges located within additional channels of said edging strips of the respective assemblies, said spine member having folds defining hinge zones between said folded back portions.

2. The combination of claim 1, wherein said edging strips interconnected by said spine member are each of multi-channel cross-section, one channel of each edging strip having said rib positioned to engage over and with said retaining abutment of the associated said sheet and another channel of each edging strip having a rib positiioned to engage over and with the free edge of said folded back portion of said spine member.

3. The combination of claim 1, wherein each said edging strip interconnected by said spine member comprises a double channel edging strip having first and second channels which open in opposite directions and have a common channel wall, said first channel having said rib projecting from said common wall and positioned to engage over and with said retaining abutment of said marginal portion of the associated sheet, and said second channel having a rib projecting inwardly of its free wall and positioned to engage over and with said folded-back edge portion of said spine member.

4. The combination of claim 3, wherein said edging strip includes a third channel facing in the same direction as said second channel and having a common wall with said first channel, said third channel having a rib projecting inwardly from its free wall and positioned to engage over and with said folded-back edge portion of a further spine member.

5. The combination of claim 1, wherein each top and bottom edging strip of said assemblies has a wall portion comprising said abutment means and serving as an end stop for said spine member to prevent lengthwise sliding thereof, an end zone of at least one of said channel walls of said top and bottom edging strips being located between said channel walls of said edging strip along each adjacent edge.

6. A substantially rigid, edged assembly for use in fabricating a panel, binder, tray, frame, box and the like, said assembly comprising a generally rectangular sheet of relatively rigid material having along its four edges marginal portions of greater thickness than the remainder of the sheet, each said marginal portion being of substantially uniform width, having an inner edge defining a retaining abutment, and being located in a channel of channel-shaped edging strip means having said channel thereof for receiving said marginal portions, said channel being defined by: a channel base; two opposed channel walls projecting from said channel base; and a rib extending along and projecting inwardly of an inner surface of one of said channel walls, said rib being spaced from said channel base by a distance corresponding to the width of said marginal portion of greater thickness and engaging over and with the retaining abutment of said marginal portion to resist separation of the edging strip means from the associated edge of said sheet in a direction perpendicular to said edge, said edging strip means being configured and dimensioned to be clipped to said edge by forcing said channel over the marginal portion in a direction generally perpendicular to said edge until said rib engages over and with said retaining abutment, said edging strip means further comprising abutment means for engaging at corners of the assembly with the edging strip means along each adjacent edge in a manner to resist sliding removal of the edging strip means from said sheet in a direction parallel to the edge to which it is assembled.

7. An assembly according to claim 6 wherein said marginal portions of greater thickness along at least two opposing edges of said sheet comprise edge portions of said sheet folded back over said sheet, and having inwardly facing free edges defining said retaining abutments.

8. An assembly according to claim 7 wherein said marginal portions of greater thickness comprise said edge portions along all four edges of said sheet folded back over said sheet.

9. An assembly according to claim 6 wherein said edging strip means, having said channel for receiving said marginal portions of the sheet, is also provided with at least one additional channel oriented generally perpendicularly to said channel, said at least one additional channel being used for receiving a like marginal portion of another sheet, and being defined by: a common part of a wall of said channel constituting an additional channel base; two opposed additional channel walls projecting from said additional channel base; and a rib extending along and projecting inwardly of an inner surface of one of said additional channel walls, whereby to enable the formation of a substantially rigid box-like structure.

10. An assembly according to claim 6 wherein said edging strip means along each edge is mitered at said corners of said assembly.

11. An assembly according to claim 6 wherein corner regions of said sheet are cut away.

12. An assembly for use in fabricating a panel, binder, tray, frame, box and the like, to store, display, secure or file records or articles, said assembly comprising a generally rectangular sheet of relatively rigid material, having edge portions along its four edges folded back over toward but spaced from an opposed surface of said sheet to form inwardly facing channel-ways along said four edges thereof, each said folded-back edge portion being of substantially uniform width, having an inner edge defining a retaining abutment and being located in a channel of channel-shaped edging strip means, said channel being defined by: a channel base; two opposed channel walls projecting from said channel base; and a rib extending along and projecting inwardly of an inner surface of one of said channel walls, said rib being spaced from said channel base by a distance corresponding to the width of said folded-back edge portion and engaging over and with said retaining abutment of said folded-back edge portion to resist separation of said edging strip means from the associated edge of said sheet in a direction perpendicular to said edge, said edging strip means being configured and dimensioned to be clipped to said edge by forcing said channel over said folded-back edge portion in a direction generally perpendicular thereto until said rib engages over and with said retaining abutment, said edging strip means further comprising abutment means for engaging at corners of said assembly with said edging strip means along each adjacent edge in a manner to resist sliding removal of said edging strip means in a direction parallel to said edge to which it is assembled, and said channel-ways being open and unobstructed by said ribs engaged over said retaining abutments along at least two opposite parallel edges of said sheet.

13. The assembly of claim 12 further comprising, an article having two opposing edge zones located and retained respectively in said channel-ways defined by said folded-back edge portions along two opposite edges of said sheet.

14. The assembly of claim 12 wherein a rectangular article has its four edges located and retained respectively in said channel-ways defined by said folded-back edge portions along said four edges of said sheet.

15. The assembly of claim 12 wherein said edging strip means along each edge is mitered at said corners of said assembly.

16. The assembly of claim 12 wherein corner regions of said sheet are cut away.

17. An assembly for use in forming a substantially rigid box and the like, said assembly comprising:

a generally rectangular sheet of relatively rigid material having edge portions along its four edges folded back over toward but spaced from an opposed surface of said sheet to form open and unobstructed inwardly facing channel-ways along said four edges thereof, each said folded-back edge portion being of substantially uniform width and having an inner edge defining a retaining abutment; and edging strip means of multi-channel cross-section engaged with said four edges of said sheet and having:

a first channel for receiving said folded-back edge portions of said sheet, said first channel being defined by: a first channel base; two opposed first channel walls projecting from said first channel base; and a rib extending along and projecting inwardly of an inner surface of one of said first channel walls; and at least one additional channel, oriented generally perpendicularly to said first channel and being used for receiving a folded-back edge portion of another sheet, said at least one additional channel being defined by: a common part of a said first channel wall constituting an additional channel base; two opposed additional channel walls projecting from said additional channel base; and a rib extending along and projecting inwardly of an inner surface of one of said additional channel walls, each said rib being spaced from its channel base by a distance corresponding to the width of said folded-back edge portion of the associated sheet engaged thereby, each said folded-back edge portion being located in the appropriate channel of said edging strip means with said rib engaging over and with said retaining abutment of said folded-back edge portion to resist separation of said edging strip means from the edge of said associated sheet in a direction perpendicular to said edge, said edging strip means being configured and dimensioned to be clipped to said edge by forcing said appropriate channel of said edging strip means over said folded-back edge portion in a direction generally perpendicular thereto until said rib engages over and with said retaining abutment, said edging strip means further comprising abutment means for engaging at corners of said assembly with said edging strip means along each adjacent edge in a manner to resist sliding removal of said edging strip means in a direction parallel to said edge to which it is assembled.

18. In combination, two assemblies each for forming a panel, binder, tray, frame, box and the like to store, display, secure or file records and articles, and comprising, a generally rectangular sheet having edge portions along its four edges folded back over toward but spaced from an opposed surface of said sheet, about folds respectively parallel to said four edges of said sheet, to form inwardly facing channel-ways along said four edges thereof, each said marginal portion having an inner edge defining a retaining abutment, each of said channel-ways being located in a channel of a channel-shaped edging strip having therealong a rib projecting inwardly of an inner surface of one of its channel walls and in engagement with said retaining abutment to resist separation of said edging strip from the associated edge of said sheet in a direction perpendicular to said edge, said edging strip being configured and dimensioned to be clipped to said channel-way by forcing said channel of said edging strip over said channel-way in a direction generally perpendicular thereto until said rib engages over and with said retaining abutment, said edging strip comprising abutment means for engaging, at adjacent corners of said assembly, with said edging strip along each adjacent edge in a manner to resist sliding removal of said edging strip in a direction parallel to said edge to which it is assembled, said channel-ways being open and unobstructed by said ribs along at least two opposite parallel edges of said sheet, and a spine member connecting together said two assemblies by two mutually parallel edging strips of said assemblies, said spine member comprising a strip of sheet material having folded-back edge portions along two opposite edges to provide marginal portions of greater thickness and substantially uniform width, each of said two mutually parallel edging strips interconnected by said spine member being of multichannel cross section, and an additional channel of each of said edging strips having therealong an inwardly projecting rib positioned to engage over and with the inner edge of a folded-back edge portion of said spine member when said folded-back edge portion is forced into the associated additional channel perpendicular to said edge, said spine member also having folds parallel to its edges to provide hinge zones between said folded-back edge portions.

19. The combination of claim 18, wherein each of said mutually parallel edging strips has first and second channels which open in opposite directions and have a common wall, said first channel having said rib projecting inwardly from said common wall and positioned to engage over and with said retaining abutment of the associated sheet of the assembly, and said second channel having a rib projecting inwardly from its free wall and positioned to engage over and with the inner edge of the associated folded-back edge portion of said spine member.

20. The combination of claim 19, wherein each of said two mutually parallel edging strips has a third channel facing in the same direction as said second channel and having a common wall with said first channel, said third channel having a rib projecting from its free wall and positioned to engage over and with the inner edge of a folded-back edge portion of a further spine member.

21. The combination of claim 18, wherein each top and bottom edging strip of said assemblies has a wall portion which serves as an end stop for said spine member and resists lengthwise sliding thereof and of the edging strip along each adjacent edge, an end zone of at least one of the channel walls of the top and bottom edging strips being located between the channel walls of said edging strip along each adjacent edge.

22. An assembly for use in fabricating a panel, binder, tray, frame, box and the like, to store, display, secure or file records or articles, said assembly comprising a generally rectangular sheet of relatively rigid material having edge portions along two of its opposed edges folded back over toward but spaced from an opposed surface of the sheet to form inwardly facing channel-ways to receive an article therein, each of said folded back edge portions being of substantially uniform width, having an inner edge defining a retaining abutment and being located in a channel of a respective channel-shaped edging strip, said channel being defined by: a channel base; two opposed channel walls projecting from said channel base; and a rib projecting inwardly of an inner surface of one of said channel walls and in engagement with the retaining abutment to resist separation of the edging strip from the associated edge of the sheet in a direction perpendicular to said edge, said edging strip being configured and dimensioned to be clipped to said edge by forcing said channel over said folded back edge portion in a direction generally perpendicular yhereto until the rib engages over and with the retaining abutment of said folded-back edge portion, said edging strip further comprises abutment means for engaging at corners of the assembly with edging means located along each adjacent edge in a manner to resist sliding removal of the edging strip in a direction parallel to the edge to which it is assembled, each of said channel-ways being open to receive an article therein, and substantially unobstructed by the rib engaged over the associated retaining abutment.

* * * * *